US005415093A

United States Patent [19]

Numauchi

[11] Patent Number: 5,415,093

[45] Date of Patent: May 16, 1995

[54] METHOD AND APPARATUS FOR PARALLEL SYNCHRONOUS OPERATION OF WEB OFFSET PRINTING PRESSES

[75] Inventor: Hiromitsu Numauchi, Toride, Japan

[73] Assignee: Komori Corporation, Tokyo, Japan

[21] Appl. No.: 241,757

[22] Filed: May 12, 1994

[30] Foreign Application Priority Data

May 18, 1993 [JP] Japan ..... 5-115637

[51] Int. Cl.[6] ..... B41F 5/08; B41F 13/12

[52] U.S. Cl. ..... 101/248; 101/181

[58] Field of Search ..... 101/247, 248, 216, 219, 101/225, 226, 228, 181, 142, 144, 145, 220, 178, 179, 180, 136–140; 318/5

[56] References Cited

U.S. PATENT DOCUMENTS 4,240,346 12/1980 Landis et al. ..... 101/181
5,184,551 2/1993 Wallmann et al. ..... 101/247
5,341,735 8/1994 Hajek ..... 101/181

*Primary Examiner*—Eugene H. Eickholt
*Attorney, Agent, or Firm*—Abelman, Frayne & Schwab

[57] ABSTRACT

In order to place web offset printing presses A and B in a synchronous operation condition by simple operation with a reduce burden to the operator, actuation of a drive clutch and a folder clutch of the machine A alone and actuation of a drive clutch of the machine B along are made detectable on a synchronous operation control panel and, under control of the control panel, a synchronous operation clutch is actuated with phase matching between the machines A and B, thereby enabling synchronous operation.

3 Claims, 4 Drawing Sheets

METHOD AND APPARATUS FOR PARALLEL SYNCHRONOUS OPERATION OF WEB OFFSET PRINTING PRESSES

FIELD OF THE INVENTION

This invention relates to a method and an apparatus for matching the rotational phases of plate cylinders of individual printing presses, for example, when two web offset printing presses are operated in parallel and in synchronization.

BACKGROUND OF THE INVENTION

Heretofore, a web offset printing press, as shown in FIG. 4, comprises a splicer infeed 1 for web feed and tension adjustment, for example, a 4-stage printing unit 2 for mono-or multicolor printing, a dryer 4, and a cooling drag 5 for cooling. The machine shown in FIG.1, further comprises first and second 2-stage folders, and the splicer infeed 1, the printing unit 2, the cooling drag 5, and the first and second folders 6 are driven by a motor 3.

In this printing press, a line shaft between the printing unit 2 and the dryer 4 is provided with a drive clutch 7, and the first and second folders 6 are also provided with folder clutches 7F. The drive clutch 7 is adjust starting under slow rotation, and the folder clutch 7F is adjust timing for phase matching between the printing unit 2 and the plate cylinder.

Timing of the folder clutch 7F is matched as follows. Since the plate cylinder makes one turn for two turns of a drive shaft of the motor 3, after tuning on the drive clutch 7, the folder clutch 7F is actuated in response to a pulse output from a detector 8 such as a limit switch for detecting two turns of the drive shaft by a pulse. Since there are two states (180° rotation or 360° rotation) in the rotational position of the plate cylinder, the folder 6 is set when it is actuated so that the folder clutch 7F is not actuated with a phase difference of half turn of the plate cylinder.

In practice, pulse output of the detector 8 of the drive clutch 7 and pulse output of the detector 8F of the folder clutch 7F are displayed on lamps on a control panel to detect a condition where the lamps simultaneously light.

A plurality of printing presses, for example, two of such a web offset printing press are disposed in parallel and operated in synchronization, and a printed matter is conducted to the folder of one printing press, thereby achieving a parallel synchronous operation method.

That is, one web offset printing press (hereinafter referred to as "machine A") as a main machine and the other web offset, printing press (hereinafter referred to as "machine B") as a sub-machine are linked by a new line shaft, and a clutch, specifically, the individual cooling drags 5 of the machine A and the machine B are connected with a line shaft and a clutch for synchronous operation to synchronize the machines A and B with each other, and webs printed by the both machines A and B are conducted to, for example, the folder 6 of the machine A to be folded.

Therefore, in parallel synchronous operation of the machines A and B, as described above, not only the folder clutch 7F must be actuated in synchronization with the phases of actuation of the drive clutch 7 and rotation of the plate cylinder, but also the drive clutch 7 for the rotation of the plate cylinder on the machine B is actuated, and then timing must be matched between the plate cylinder of the machine B and the plate cylinder and the folder of the machine A.

In the past, to connect -the machines A and B, after the actuation of the drive clutch 7 and the Folder clutch 7F of the machine A in slow operation and the drive clutch 7 of the machine B, operation of the machines was stopped, and a clutch for synchronous operation provided on the line shaft connecting the machines A and B while matching the timing was manually connected so that phases of the plate cylinders of the machines A and B were matched with each other, or the phase of the plate cylinder of the machine B was matched with t, he phase of the folder 6 of the machine A, or a synchronous operation electromagnetic clutch was connected while individually matching the timing on the individual control panels of the machines A and B.

However, such manual connection or connection on the individual control panels of the individual clutches for synchronous operation while matching the timing of the machines A and B is a tedious work and a burden to the operator.

A primary object of the present invention is to provide a method and apparatus for parallel synchronous operation of weld offset printing presses which enables exact phase matching by a simple operation with a reduced burden to the operator.

SUMMARY OF THE INVENTION

In accordance with the present invention, in order to place web offset printing machines A and B under a synchronous operation condition by simple operation with a reduced burden to the operator, connection of a drive clutch and a folder clutch of the machine A alone, and connection of a drive clutch of the machine B alone are made detectable on a synchronous operation control panel, phases of the machines A and B are matched under control of the control panel, and a synchronous operation clutch is connected to achieve synchronous operation.

DETAILED DESCRIPTION OF PREFERRED EMBODIMENTS

Figure 1:
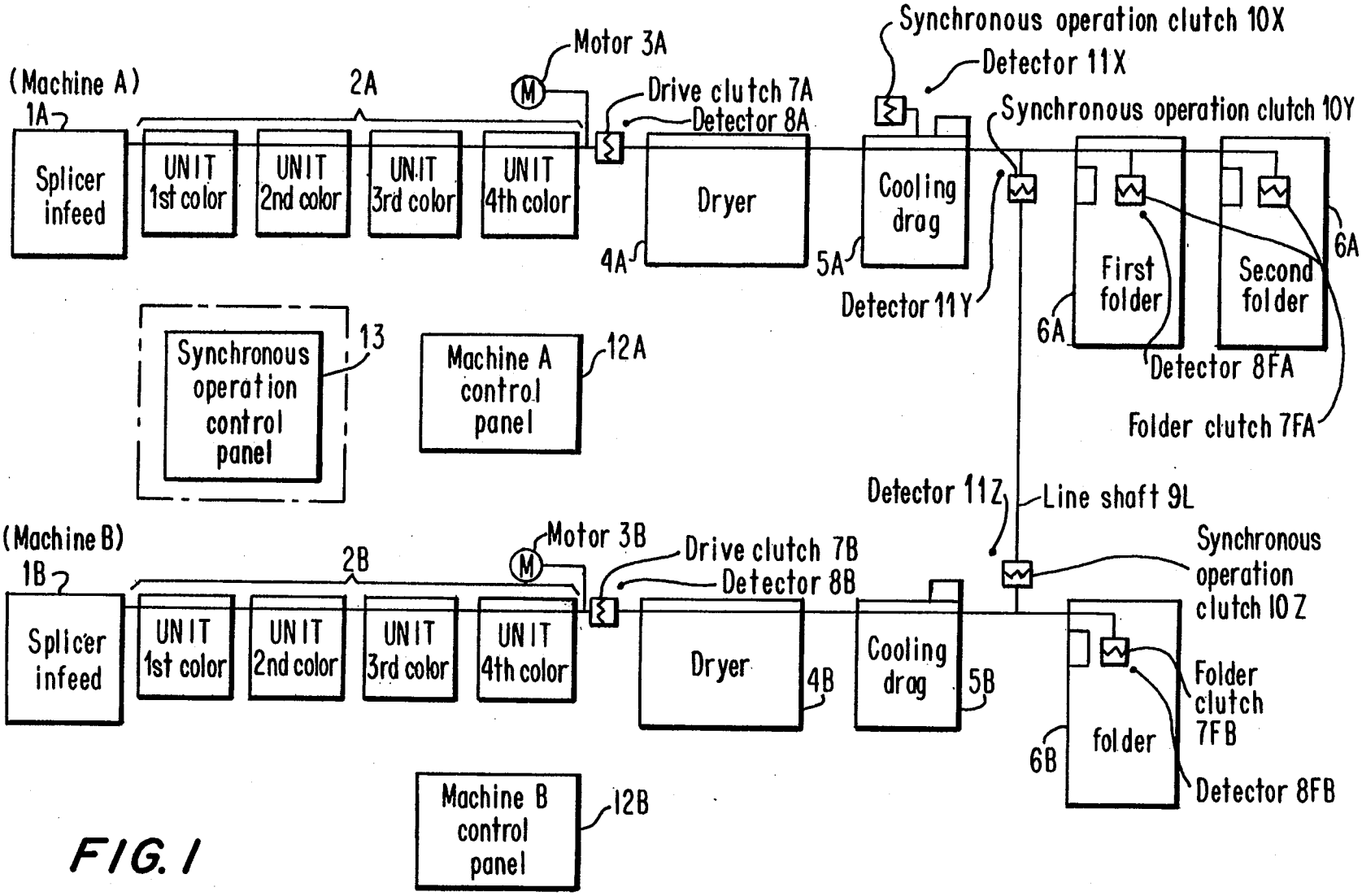
FIG. 1 is a block diagram showing the construction of the parallel synchronous operation system according to the present invention.

Preferred embodiments of the present invention will be described with reference to FIGS. 1 to 3. FIG. 1 shows main and sub-web offset printing presses, that is, machines A and B, which are put on parallel synchronous operation. The machines A and B individually can be operated independent of each other. The machine A, as in FIG. 1, comprises a splicer infeed 1A, a 4-stage printing unit 2A, a motor 3A, a drive clutch 7A, a dryer 4A, a cooling drag 5A, two folders 6A, a folder clutch 7FA, and an independent operation control panel 12A for instructing and displaying operation condition, clutch operation, and the like.

Similarly, the machine B comprises a splicer infeed 1B, a printing unit 2B, a motor 3B, a drive clutch 7B, a dryer 4B, a cooling drag 5B, a folder 6B, a folder clutch 7FB, and an independent operation control panel 12B.

In the both machines A and B, the drive clutches 7A and 7B and the folder clutches 7FA and 7FB are individually provided with detectors 8A, 8B, 8FA, and 8FB such as limit switches, which detect ON/OFF of each clutch and rotational phase as a connection timing. That is, "clutch ON" can be detected by detecting the shaft rotation, and the phase of the printing unit with respect to the plate cylinder can be detected by the actuation of the drive clutches 7A and 7B and the folder clutches 7FA and 7FB. For the latter, as described above, since the relation that two turns of the drive shaft of the motors 3A and 3B correspond to one turn of the plate cylinder is defined, when the position of 0° or after a half turn (180°) of the plate cylinder corresponds to the rotational position of the drive shaft, 0° or 180° of the plate cylinder can be determined by connection of the drive clutches 7A and 7B or the folder clutches 7FA and 7FB. Each of the clutches 7A, 7B, 7FA, and 7FB is preferably an engaging clutch which engages only at a position in the rotational direction. In this case, with the clutch ON, the relative rotational positions of the line shafts of the drive side and driven side are fixed, but the rotational position of the plate cylinder is 0° or 180°.

Therefore, actuation of the drive clutches 7A and 7B and the folder clutches 7FA and 7FB can be in line with rotational position off 0° or 180° of the plate cylinder, and the phase of each of the clutches and the folders 6A and 6B with respect to the plate cylinder can be matched if the timing of clutch ON/OFF is matched on the individual control panels 12A and 12B.

Referring to FIG. 1, to achieve synchronous operation of the machines A and B, a new line shaft 9L and synchronous operation clutches 10X, 10Y, and 10Z for connecting the machines A and B, and a synchronous operation control panel 13 are provided. Further, detectors 11X, 11Y, and 11Z are provided to detect ON/-OFF of the synchronous operation clutches 10X, 10Y, and 10Z. The synchronous operation clutch 10Y is to turn on and off between the machine A and the line shaft 9L, the synchronous operation clutch 10Z is to turn on and off between the machine B and the line shaft 9L, and the synchronous operation clutch 10X is to turn on and off a guide drive roll (not shown) for conducting web from the machine B to the folder 6A during synchronous operation.

Figure 2:
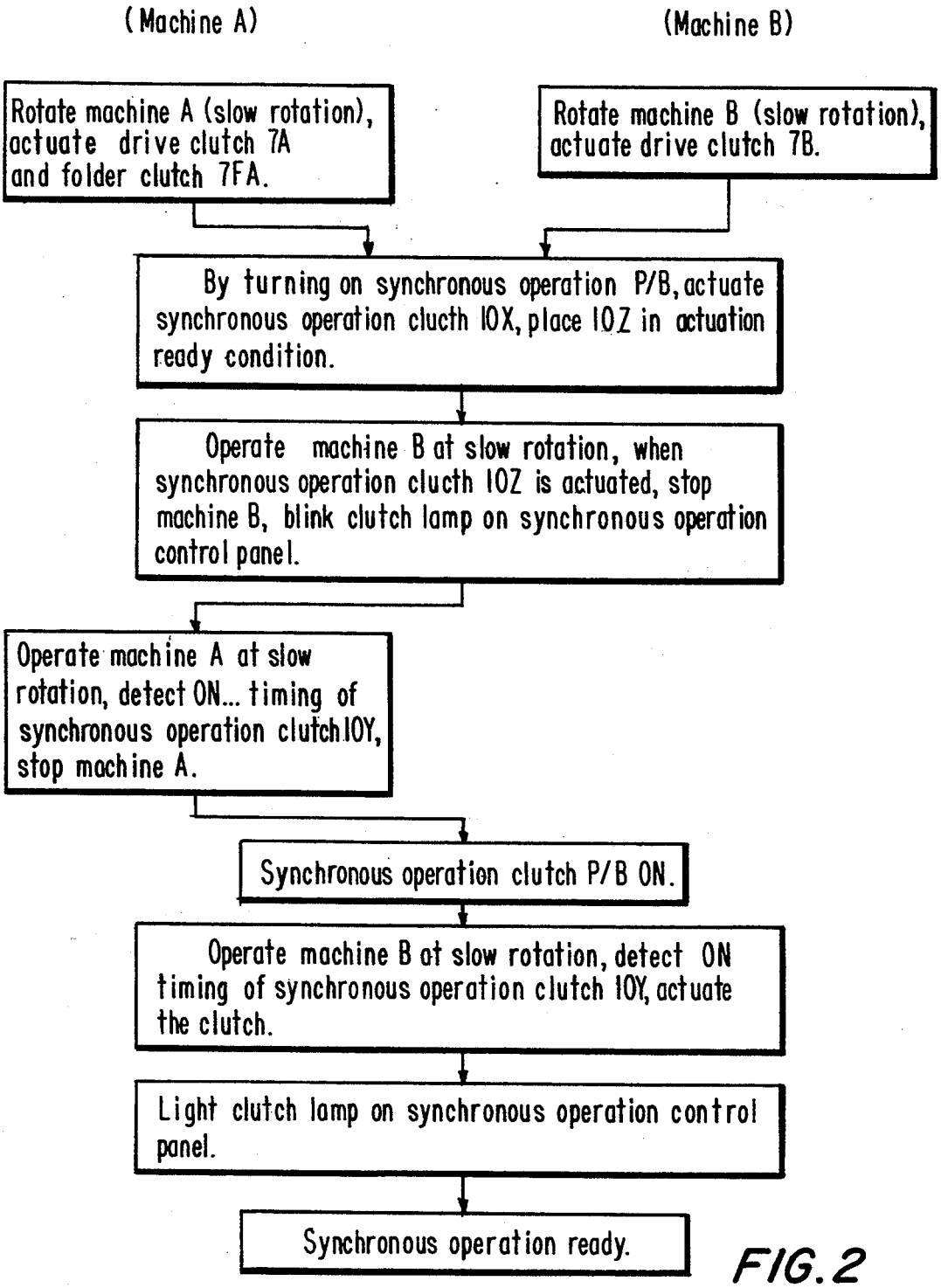
FIG. 2 is an operation flow chart of an example of synchronous operation.
Figure 3:
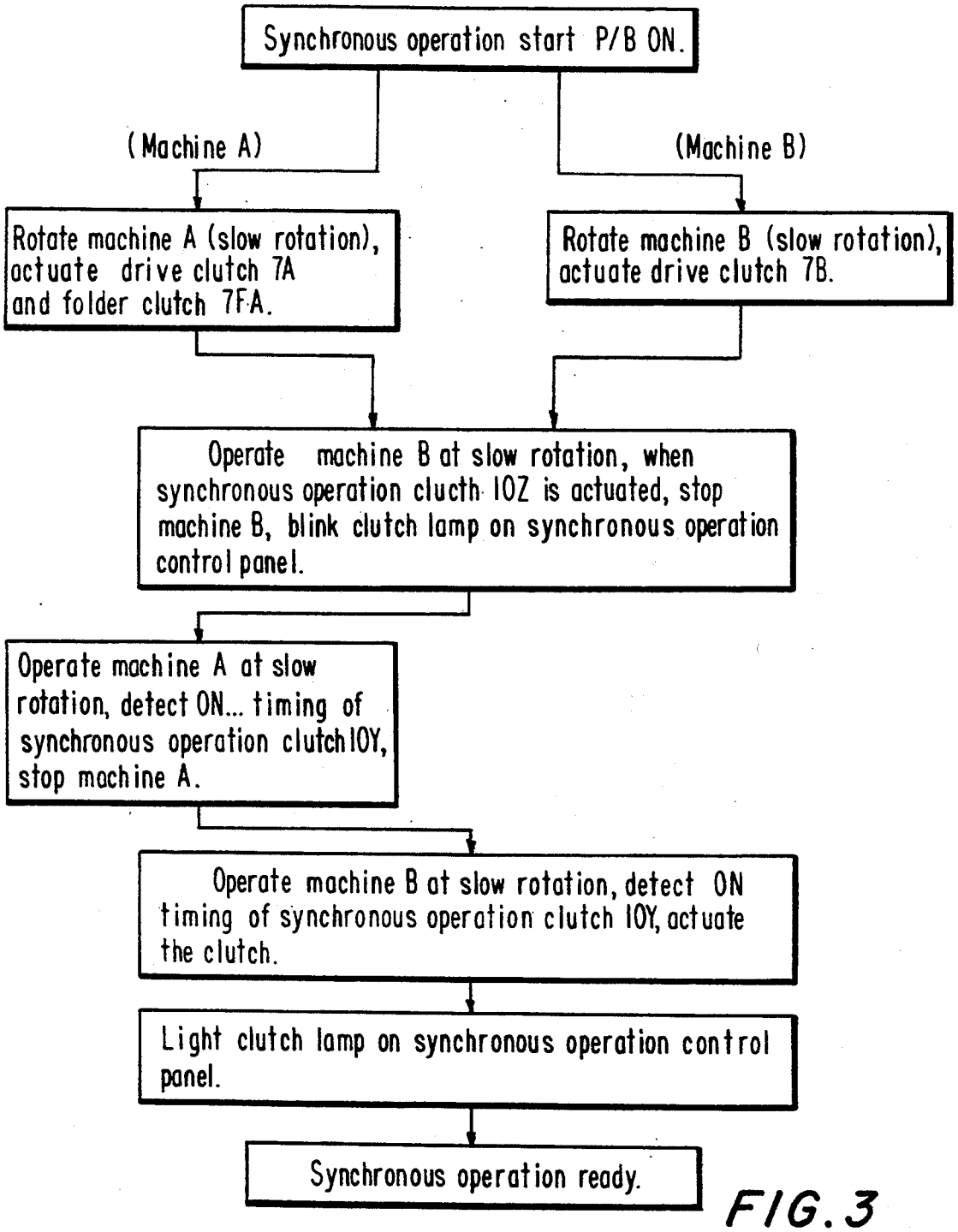
FIG. 3 is an operation flow chart of a modified example of synchronous operation.
Figure 4:
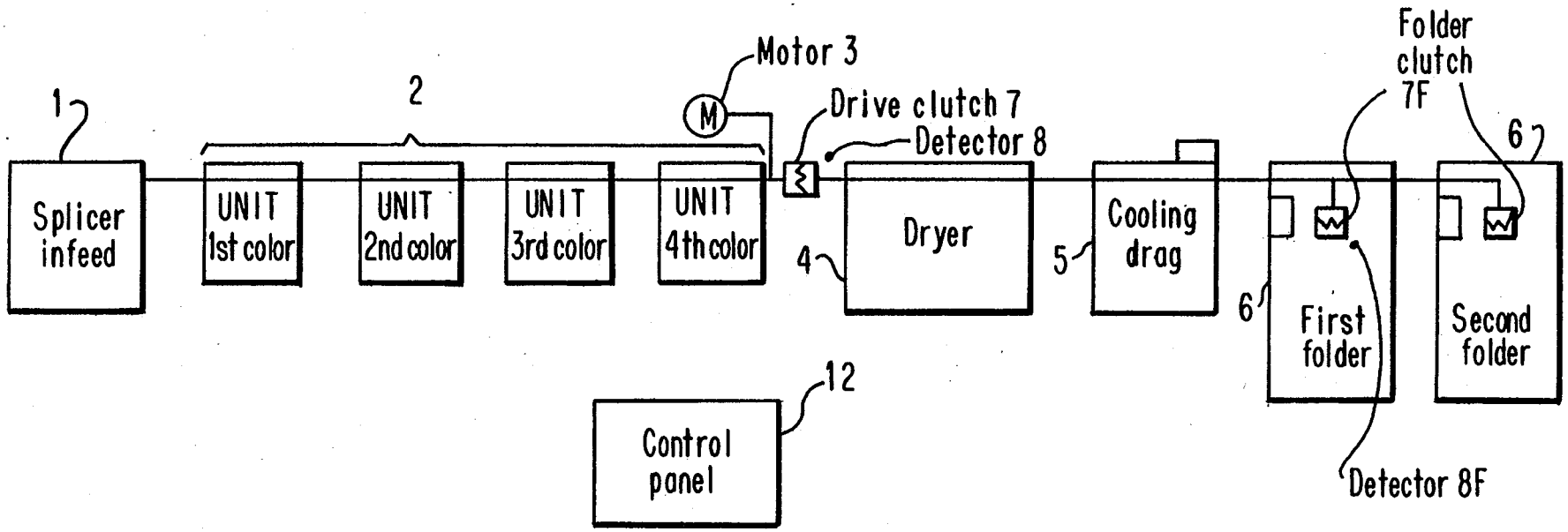
FIG. 4 is a block diagram showing operation of a single web offset printing press.

Parallel synchronous operation of the machines A and B shown in FIG 1 is carried out according to the flow chart shown in FIG. 2. Referring to FIG. 2, (1S) by the function of the machine A control panel 12A, the machine A is operated at a slow rotation of a very low rotational speed, and the drive clutch 7A and the folder clutch 7FA are connected under matched timing as described above. Specifically, the drive clutch 7A and the folder clutch 7FA are connected, the machine A is operated at a slow rotation, and outputs of the detectors 8A and 8FA are detected. Simultaneous 0N condition of the outputs of the both detectors 8F and 8FA means a phase matching. If not, while continuing slow operation, the drive clutch 7A is once released and, after a predetermined time, the drive clutch 7A is connected again, thereby achieving connection of the clutches 7A and 7FA of the machine A side with matched timing.

On the other hand, (2S) by the function of the machine A control panel 12A, the machine A is operated at a slow rotation by the function of the machine B control panel 12B, and the drive clutch 7B is connected. Since, after clutch connection under slow rotation of the individual machines A and B, phases of the clutches 7A and 7FA are in line and the clutch 7B is actuated, the machines are stopped. This prevents the operator from an accident.

Then, (3S) apart from independent operation of the machines A and B, the machines proceed to the operation by the newly provided synchronous operation control panel 13. By turning on a synchronous operation clutch pushbutton (P/B) of the control panel 13, the synchronous operation clutch 10X is actuated, and 10Z is placed in a actuation inhibition release (actuation ready) condition.

Next, (4S) when the machines are rotated by operating the synchronous operation control panel 13, only the machine B is operated at slow rotation, when the synchronous operation clutch 10Z is actuated, the machine B is automatically stopped by an output of the detector 11Z, and a clutch lamp on the synchronous operation control panel 13 begins blinking. This blinking indicates actuation of the clutch 10Z and a synchronous operation ready condition.

Then, (5S) the machine A is operated at slow rotation by operating the machine A control panel 12A, and an ON timing of the synchronous operation clutch 10Y is detected by the detectors 8A and 8FA to stop the machine A automatically.

(6B) When the machines are operated by turning on the synchronous operation clutch pushbutton P/B of the synchronous operation control panel 13, (7S) only the machine B is operated at slow rotation, ON timing of the synchronous operation clutch 10Y is detected by the detector 8B to connect the clutch 10Y, and (8S) the clutch lamp on the synchronous operation control panel 13 changes from blinking to continuous lighting. As a result, (9S) parallel synchronous operation of the machines A and B by the synchronous operation control panel 13 becomes possible. In this condition, independent operation by the individual control panels 12A and 12B is impossible.

Alternatively, in the above embodiment, another operation may be used in which (5S) when the machine B is operated at slow rotation by operating the machine B control panel 12B, the ON timing position of the synchronous operation clutch 10Y is detected by the detector 8B, the machine B is automatically stopped and, in (6S) the machines are operated by turning on the synchronous operation clutch pushbutton P/B on the synchronous operation control panel 13, (7S) only the machine A is operated at slow rotation, the ON timing position of the synchronous operation clutch 10Y is detected by the detectors 8A and 8FA to connect, the clutch 10Y.

As individually described above, the detectors 8A, 8FA, and 8B detect ON/OFF timing of the clutches 7A, 7FA, and 7B, but, only ON/OFF of the detectors 11X, 11Y, and 11Z. Further, the drive clutches 7A and 7B, the folder clutches 7FA and 7FB, and the synchronous operation clutches 10Y and 10Z are preferably an engaging clutch which engages at a position.

The present; embodiment describes an example in which the machine A is used as a main machine, and the web from the machine B is delivered to the folder of the machine A and, therefore, in synchronous operation, the folder 6B, the folder clutch 7FB, and the detector 8FB are not used.

The operation shown in FIG. 2 is for an existing apparatus for independent operation of the machines A and B which is improved for synchronous operation. However, as shown in FIG. 3, when the apparatus is previously provided for synchronous operation by the synchronous operation control panel as a main operation, the operation may be such that (10S) by the instruction off turning on the pushbutton P/B on the synchronous operation control panel 13, the drive clutch 7A and the folder 7FA of the machine A are actuated, (2S) the drive clutch 7B off the machine B is actuated, (4S) the machine B is operated at slow rotation to actuate the synchronous operation clutch 10Z, the clutch lamp on the synchronous operation control panel 13 is blinked, (5S) the machine A is operated at slow rotation, the timing position of the synchronous operation clutch 10Y is detected, and the machine A is stopped, (7S) the machine B is operated at slow rotation, the ON timing of the synchronous operation clutch 10Y is detected to actuate the clutch 10Y, and (8S) the clutch lamp is blinked to achieve a synchronous operation ready condition.

Alternatively, in the above embodiment, the operation may be such that (5S) the machine B is operated at slow rotation, the timing position of the synchronous operation clutch 10Y is detected to stop the machine B, (7S) the machine A is operated at slow rotation, and the ON timing position of the synchronous operation clutch 10Y is detected to actuate the clutch 10Y.

Further, synchronous operation can also be easily achieved when the synchronous operation clutch 10Z is not provided and the machine B and the line shaft 9L are always connected, or when the synchronous operation clutch 10Y is not provided and the machine A and the line shaft are always connected.

As described above, the present embodiment eliminates the need for a tedious work by the operator for clutch phase matching of the machines A and B which is required by the prior art, ON/OFF checking is not required, timing and ON/OFF of the clutches necessary for synchronous operation can be placed under the control of the synchronous operation control panel, thereby achieving improved operability and safety and saving of time.

I claim:

1. A parallel synchronous operation method of web offset printing presses comprising the steps of:

actuating a clutch connecting a drive system of a web offset printing press A while matching a timing;

actuating a clutch connecting a drive system of a web offset printing press B; and while operating said printing press A or B at a slow rotation by operation on a synchronous operation control panel, detecting an ON timing of a synchronous operation clutch connecting said printing presses A and B to actuate said clutch.

2. The parallel synchronous operation method of web offset printing presses of claim 1, wherein in actuating said synchronous operation clutch for connecting said printing presses A and B on said synchronous operation control panel, a connection timing position of said clutch in said printing press A while checking a connectable condition of said clutch, and said printing press B is connected in line with timing of said printing press A by actuation of said clutch.

3. The parallel synchronous operation method of web offset printing presses of claim 2, wherein a clutch lamp is blinked on said synchronous operation control panel in a connectable condition of said synchronous operation clutch, and said clutch lamp is continuously lit on actuation of said clutch.

* * * * *